US010677012B2

(12) United States Patent
Oag et al.

(10) Patent No.: US 10,677,012 B2
(45) Date of Patent: Jun. 9, 2020

(54) PLUG

(71) Applicant: Spex Services Limited, Aberdeenshire (GB)

(72) Inventors: Jamie Oag, Aberdeenshire (GB); Rae Younger, Aberdeenshire (GB)

(73) Assignee: SPEX CORPORATE HOLDINGS LIMITED, Aberdeen (GB)

( * ) Notice: Subject to any disclaimer, the term of this patent is extended or adjusted under 35 U.S.C. 154(b) by 101 days.

(21) Appl. No.: 15/513,243

(22) PCT Filed: Sep. 22, 2015

(86) PCT No.: PCT/GB2015/052738
§ 371 (c)(1),
(2) Date: Mar. 22, 2017

(87) PCT Pub. No.: WO2016/046533
PCT Pub. Date: Mar. 31, 2016

(65) Prior Publication Data

US 2018/0230770 A1 Aug. 16, 2018

(30) Foreign Application Priority Data

Sep. 22, 2014 (GB) ..... 1416720.9

(51) Int. Cl.

| | |
|---|---|
| ***E21B 33/12*** | (2006.01) |
| ***E21B 33/134*** | (2006.01) |
| ***E21B 34/06*** | (2006.01) |
| ***E21B 43/1185*** | (2006.01) |

(52) U.S. Cl.
CPC ..... *E21B 33/1208* (2013.01); *E21B 33/12* (2013.01); *E21B 33/134* (2013.01); *E21B 34/063* (2013.01); *E21B 43/11852* (2013.01)

(58) Field of Classification Search
CPC .. E21B 33/1208; E21B 33/134; E21B 34/063; E21B 43/11852
See application file for complete search history.

(56) References Cited

U.S. PATENT DOCUMENTS

| | | | | |
|---|---|---|---|---|
| 5,479,986 | A | 1/1996 | Gano et al. | |
| 7,712,521 | B2 | 5/2010 | Sorensen | |
| 2006/0185898 | A1 * | 8/2006 | Seekford | E21B 43/263 175/4.6 |
| 2009/0101358 | A1 | 4/2009 | Bjorgum | |

(Continued)

FOREIGN PATENT DOCUMENTS

WO 2009116871 A1 9/2009

OTHER PUBLICATIONS

International Search Report and Written Opinion dated Jan. 5, 2016 for corresponding International application No. PCT/GB2015/052738.

(Continued)

*Primary Examiner* — Giovanna C Wright
*Assistant Examiner* — Brandon M Duck
(74) *Attorney, Agent, or Firm* — Tarolli, Sundheim, Covell & Tummino LLP

(57) ABSTRACT

An improved plug for sealing a tubular as described. The improved plug comprises a plug body, the plug body comprising a propellant and an initiator adapted to initiate the propellant upon a signal. Upon initiation the propellant deflagrates causing the plug body to at least partially disintegrate.

11 Claims, 9 Drawing Sheets

(56) References Cited

U.S. PATENT DOCUMENTS

| | | | | |
|---|---|---|---|---|
| 2009/0308620 | A1* | 12/2009 | Tilghman | E21B 33/12 166/387 |
| 2012/0073805 | A1 | 3/2012 | Shampine et al. | |
| 2013/0081825 | A1 | 4/2013 | Lynde et al. | |
| 2015/0275643 | A1* | 10/2015 | Holder | E21B 43/263 166/63 |

OTHER PUBLICATIONS

Examination Report for corresponding European Application No. 15785170, dated Apr. 24, 2018, pp. 1-5.

* cited by examiner

PLUG

RELATED APPLICATIONS

The present application is a U.S. National Stage Application under 35 USC 371, claiming priority to Serial No. PCT/GB2015/052738, filed on Sep. 22, 2015; which claims priority from European Application No. 1416720.9, filed Sep. 22, 2014, the entirety of both are incorporated herein by reference.

FIELD OF THE INVENTION

The present invention relates to an improved plug for use particularly, but not exclusively, in oil wells

BACKGROUND TO THE INVENTION

The use of plugs to seal tubulars or the annulus between tubulars in the oil and gas industry is well known. Plugs are usually run down the well on the setting tool and are set in position. With the plug in place, various operations can be performed such as pressure testing of a section of tubular or perforation of the section of tubular amongst others. The plug acts as a barrier to contain pressure or well fluids etc.

Upon completion of the operation, a removal tool is sent down to recover the plug to surface.

The recovery of the plug can be a time-consuming operation particularly if the plug was damaged during the setting process or during use.

SUMMARY OF THE INVENTION

According to a first aspect of the present invention there is provided an improved plug for sealing a tubular; the improved plug comprising:

a plug body, the plug body comprising a propellant; and an initiator adapted to initiate the propellant upon a signal;

wherein upon initiation the propellant deflagrates causing the plug body to at least partially disintegrate.

In at least one embodiment of the present invention, a plug is provided which can at least partially collapse upon ignition or initiation and the subsequent deflagration of a propellant. Such an arrangement allows for this part of the plug body to essentially disappear reducing the amount of material which collapses down the tubular.

The plug body may fully comprise a propellant.

The plug body may partially comprise a propellant.

The propellant may disintegrate by being consumed.

The plug body may comprise a propellant and at least one other material.

In one embodiment, where the plug body comprises a propellant and at least one other material, only the propellant disintegrates.

In one embodiment, where the plug body comprises a propellant and at least one other material, both the propellant and the at least one other material disintegrates. Disintegration may occur by, for example, the propellant being consumed through burning and the other material, which may be a salt, for example, dissolving in well fluid.

The plug body may comprise a composite of a propellant and at least one other material.

The composite may comprise a strengthening material in a matrix of propellant material.

The at least one other material may be fibrous.

The at least one of the material may be carbon fibre or any suitable material.

The plug body may comprise strengthening members.

The strengthening members may be metallic.

Alternatively or additionally strengthening members may be fibrous, such as carbon fibre.

The strengthening members may be, alternatively or additionally, chippings of, for example, rock, glass or stone.

In other alternative embodiments, the strengthening members may be rubbers or elastomers or indeed any suitable material.

The strengthening members may be arranged in a formation.

The strengthening members' formation may be keyed by the propellant. Propellant may be used to hold the strengthening members together. In at least one embodiment of the invention, upon ignition of the propellant, the support provided by the propellant is lost causing the strengthening members to collapse under their own weight. In alternative embodiments the propellant may be used to hold the strengthening members in a collapsed configuration. In at least one embodiment of the invention, upon ignition of the propellant, the support provided by the propellant is lost causing the strengthening members to expand into a deployed configuration. In further examples, the propellant may be used to reverse the expansion to the deployed configuration to bring the strengthening members back to a collapsed configuration.

The at least one other material may be expandable. An expandable material may be used to facilitate the seal between the plug and the tubular.

The at least one other material may be adapted to expand upon disintegration of the propellant.

The at least one other material may be adapted to expand in response to a compression force.

The at least one other material may be adapted to expand radially.

The plug may further comprise a coating adapted to protect the plug body from exposure to an environment within the tubular.

The coating may be a propellant.

The plug may further comprise a housing, the housing adapted to receive the plug body.

The housing may be adapted to engage, in use, a tubular wall.

The housing may be adapted to engage, in use, an internal tubular wall.

The housing may be configurable.

The housing may expandable from a reduced configuration to an expanded configuration. In the expanded configuration the housing may be adapted to engage an internal tubular wall. The housing may comprise adjacent plates for example, which expand the housing as they slide passed on another.

The plug body may expand to expand the housing into engagement with an internal tubular wall.

The plug body may comprise an expandable foam.

The plug body may be adapted to inflate under the action of the propellant or by some other means.

The plug may be adapted to be compressed.

The plug may be adapted to be compressed in any orientation.

Compression of the plug may, in use, engage the housing with the tubular wall.

The plug may further comprise one or more sensors.

The/each sensor may be adapted to monitor a well condition.

In at least one embodiment, at least one sensor may be adapted to measure temperature in a well location.

In at least one embodiment, at least one sensor may be adapted to measure pressure in a well location.

In at least one embodiment, at least one sensor may be adapted to measure chemical composition in a well location.

In at least one embodiment, at least one sensor may be adapted to measure flow rate in a well location.

In at least one embodiment there may be multiple sensors adapted to measure a differential in a well condition between two locations.

In at least one embodiment the multiple sensors are adapted to measure differential in a well condition across the plug. For example, if the plug was installed to contain a pressure in the well, and the pressure was subsequently equalised across the plug, it may then be desirable to remove the plug.

In at least one embodiment the plug may further comprise a transmitter, transmitter being adapted to transmit information from the sensors to a remote location such as surface.

In at least one embodiment, the plug may further comprise a receiver adapted to transmit information from location to the surface.

According to a second aspect the present invention there is provided an improved plug for sealing a tubular; the improved plug comprising:

a plug body, the plug body comprising a consumable; and an initiator adapted upon a signal to expose the consumable to a condition in which it will be consumed causing the plug body to at least partially disintegrate.

The consumable may be a propellant

The initiator may ignite the consumable.

The initiator may generate a spark to ignite the consumable.

The initiator may generate heat to ignite the consumable.

In other embodiments the initiator may expose the consumable to an environmental condition which causes the consumable to be consumed.

The initiator may be hydraulically controlled.

Additionally or alternatively, the initiator may be electrically controlled.

Additionally or alternatively, the initiator may be acoustically controlled.

Additionally or alternatively, the initiator may be mechanically controlled.

The consumable may comprise magnesium or another material which may react to well fluid.

The consumable may comprise a material which reacts to non-well fluids.

According to a third aspect the present invention there is provided an improved tool for sealing a tubular; the improved tool comprising:

a tool portion body, the tool portion comprising a consumable; and an initiator adapted upon a signal to expose the consumable to a condition in which it will be consumed causing the tool portion to disintegrate.

According to a fourth aspect of the present invention there is provided an improved plug for sealing a tubular; the improved plug comprising:

a plug body, the plug body comprising a propellant; and a initiator adapted to ignite the propellant upon a signal;

wherein upon deflagration the propellant burns away causing the plug body to disintegrate.

The plug body may partially disintegrate.

According to a fifth aspect of the present invention there is provided an improved tool for use downhole; the improved tool comprising:

a tool body, the tool body comprising a propellant; and an initiator adapted to initiate the propellant upon a signal;

wherein upon initiation the propellant deflagrates causing the tool body to at least partially disintegrate.

In at least one embodiment of the present invention, the tool may be a tubing hanger or liner hanger adapted to be located in a wellbore to permit a further tool to be suspended in the wellbore to do a specific job. Upon completion of the job, the tool of the present invention may be disintegrated by deflagration of the propellant.

The tool body may fully comprise a propellant.

The tool body may partially comprise a propellant.

The propellant may disintegrate by being consumed.

The tool body may comprise a propellant and at least one other material.

In one embodiment, where the tool body comprises a propellant and at least one other material, only the propellant disintegrates.

In one embodiment, where the plug body comprises a propellant and at least one other material, both the propellant and the at least one other material disintegrates. Disintegration may occur by, for example, the propellant being consumed through burning and the other material, which may be a salt, for example, dissolving in well fluid.

The tool body may comprise a composite of a propellant and at least one other material.

The tool may further comprise one or more sensors.

In at least one embodiment the tool may further comprise a transmitter, transmitter being adapted to transmit information from the sensors to a remote location such as surface. In at least one embodiment, the plug may further comprise a receiver adapted to transmit information from location to the surface.

It will be understood that features of one aspect may be equally applicable to the other aspect and are not repeated for brevity.

BRIEF DESCRIPTION OF THE DRAWINGS

Embodiments of the present invention will now be described with reference to the accompanying drawings in which.

DETAILED DESCRIPTION OF THE DRAWINGS

Figure 1:
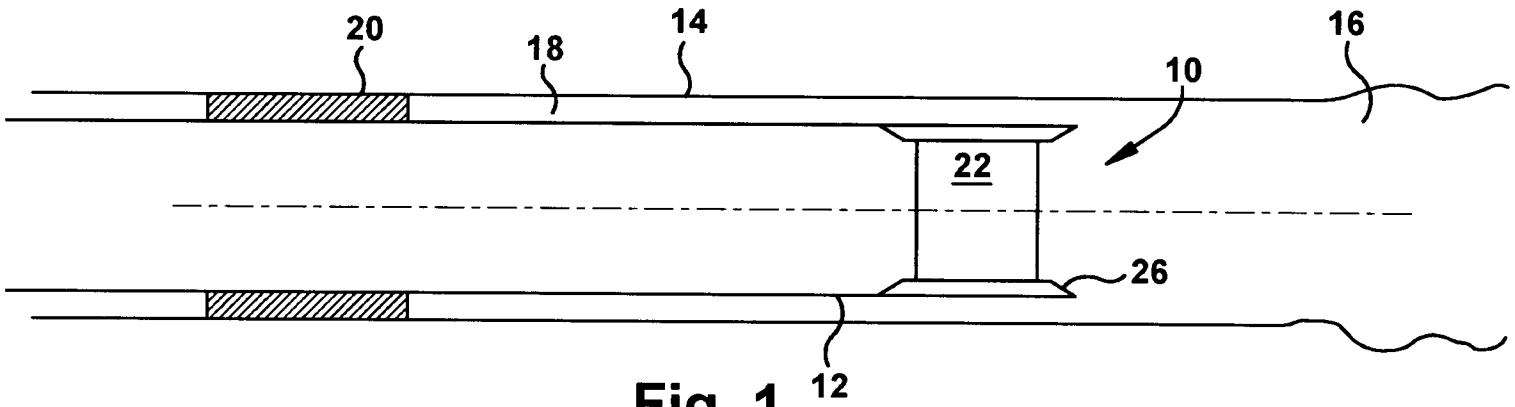
FIG. 1 is a schematic of a plug shown fitted in an oil well tubular prior to ignition according to a first embodiment of the present invention.

Reference is first made to FIG. 1, a schematic of a plug, generally indicated by reference numeral 10, shown fitted in a well tubular 12 according to a first embodiment of the present invention.

The tubular 12 is located within a cased portion 14 of wellbore 16. The annulus 18 between the well tubular 12 and the wellbore cased portion 14 is sealed by a packer 20.

The plug 10 seals the well tubular 12 from downhole pressure.

Figure 3:
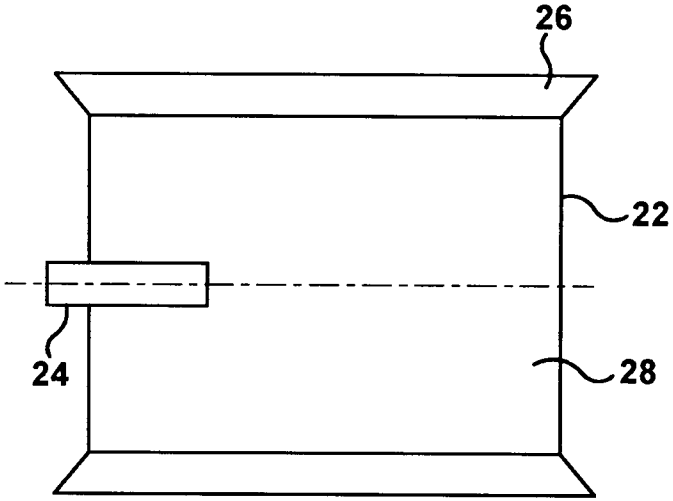
FIG. 3 is schematic of the plug of FIG. 1.

The plug 10 can be seen in more detail on FIG. 3, a schematic of the plug 10 of FIG. 1. The plug 10 comprises a plug body 22 made of a block of propellant 28, particularly potassium perchlorate, an initiator 24 and a plug housing 26.

Figure 2:
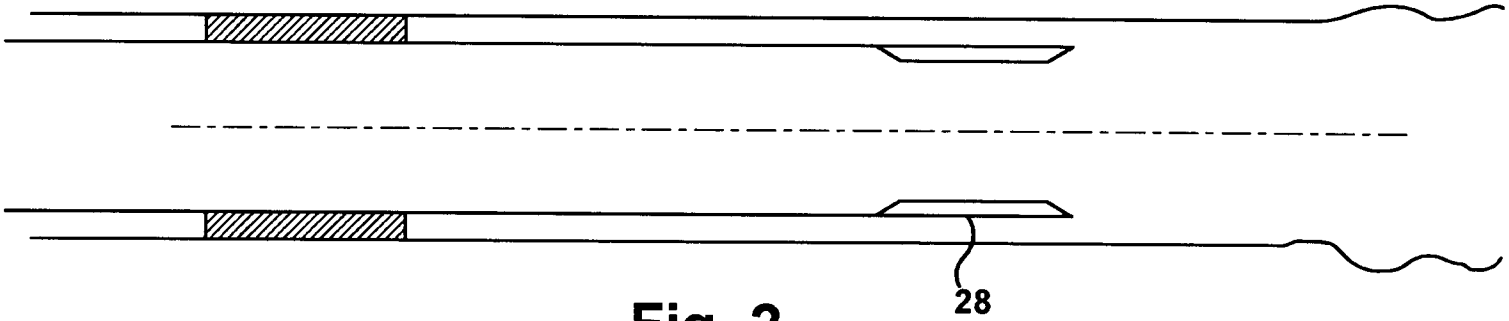
FIG. 2 is a schematic showing the plug of FIG. 1 after ignition.

Activation of the initiator 24 by a signal from surface results in the propellant block 28 burning away leaving only the housing 26 in the well tubular 12, as shown in FIG. 2.

In alternative embodiments the plug body 22 could be made of a foam matrix permitting the plug 10 to be lowered in to the wellbore cased portion 14 passed a restriction (not shown). Once in position, a propellant could activate the foam such that the plug housing 26 is pushed outwards into engagement with the wellbore cased portion 14.

Figure 4:
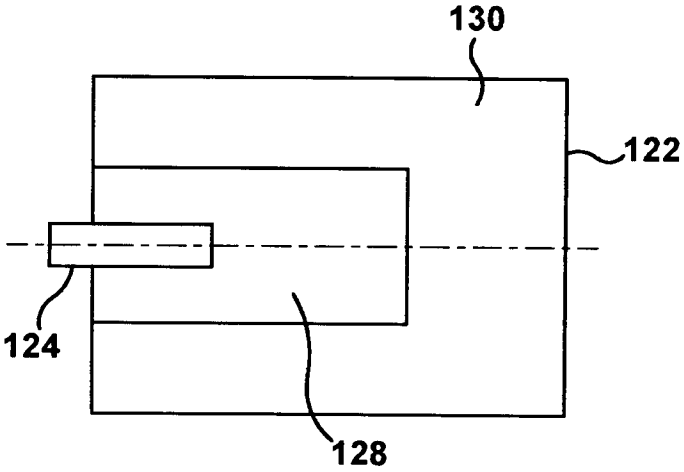
FIG. 4 is a schematic of a plug according to a second embodiment of the present invention.

An alternative plug 110, according to a second embodiment of the present invention is shown in FIG. 4. This plug 110 has a body 122 comprising a propellant block 128 surrounded by composite 130 of compressed gravel or glass in a propellant matrix. In this case the propellant block 128 supports the composite 130 and ignition of the propellant block 128 causes the propellant block 128 and the propellant matrix to burn away resulting in collapse of the composite 130.

Figure 5:
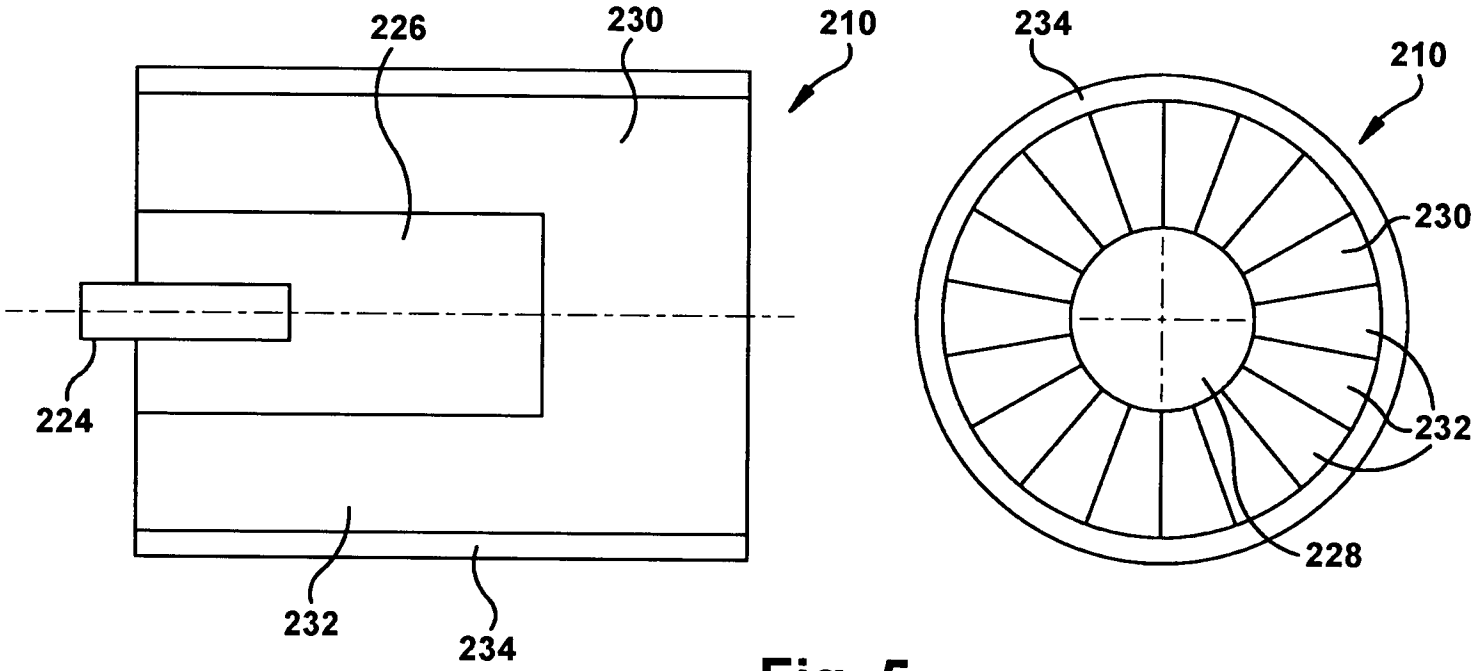
FIG. 5 a schematic of a plug according to a third embodiment of the present invention.

An alternative plug 210 according to a third embodiment of the present invention is shown in FIG. 5. Again this plug 210 comprises an initiator 224 a propellant block 228 and a collapsible matrix 230. Referring to FIG. 5B, an end view of the plug 210 it can be seen that the collapsible matrix 230 is a series of metallic segments 232 contained within a rubber sleeve 234. The segments 232 are keyed together by the propellant block 228. Once the initiator 224 triggers the propellant block 228, the block 228 will burn away and the metal segments 232 and the remainder of the plug 210 can fall apart.

Figure 6:
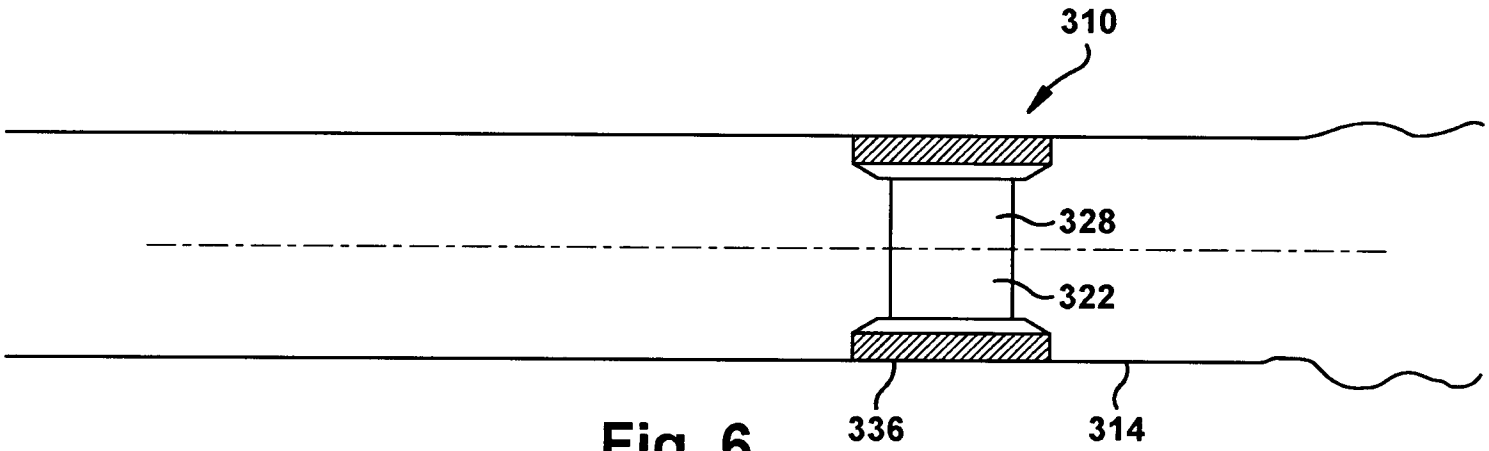
FIG. 6 is a schematic of a plug according to a fourth embodiment of the present invention shown fitted in an open hole prior to ignition.

FIG. 6 shows a schematic of a plug 310 according to a fourth embodiment of the present invention. The primary difference of this plug 310 is that it is intended for setting in a cased wellbore 314 rather than a wellbore tubular. The plug 310 incorporates rubber sealing pads 336 adapted to form a sealing engagement with the cased wellbore 314.

Figure 7:
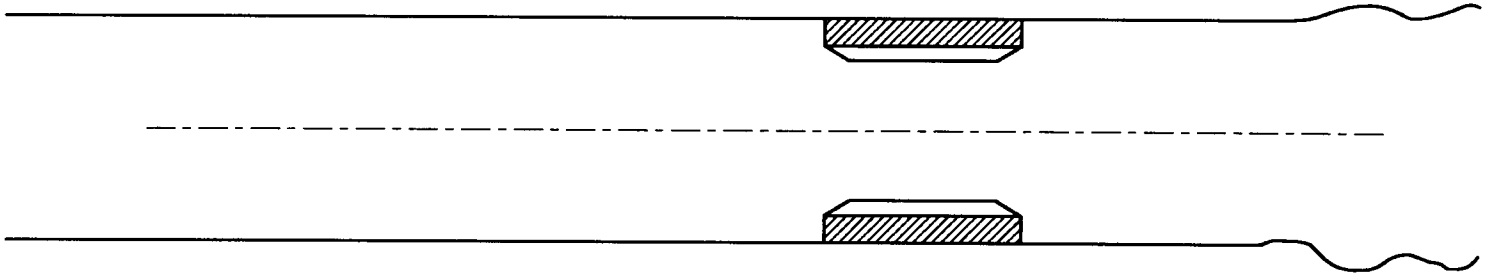
FIG. 7 is a schematic showing the plug of FIG. 6 after ignition.

Again, the plug body 322 comprises a block of propellant 328 which burns away as shown in FIG. 7 upon initiation.

Figure 8:
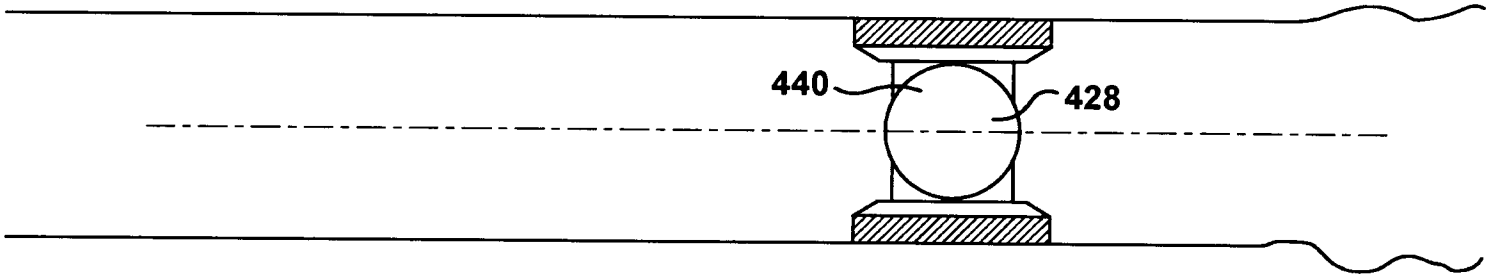
FIG. 8 is a schematic of a tool according to a fifth embodiment of the present invention shown fitted in oil well.
Figure 9:
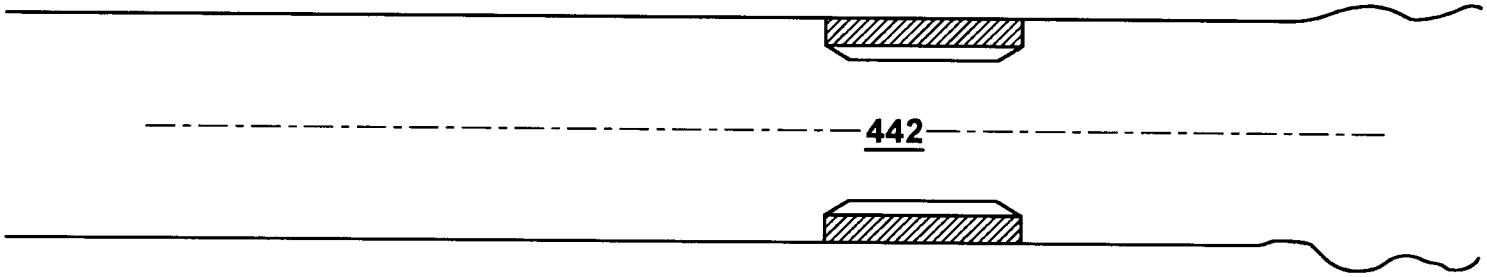
FIG. 9 is a schematic showing the plug of FIG. 8 after ignition.

A fifth embodiment shown in FIGS. 8 and 9. In this embodiment, the propellant body portion 428 is the ball and ball housing in a ball valve 440. Again when the initiation happens the ball and ball housing 428 burn up leaving a clear through bore 442, as shown in FIG. 9.

Figure 10:
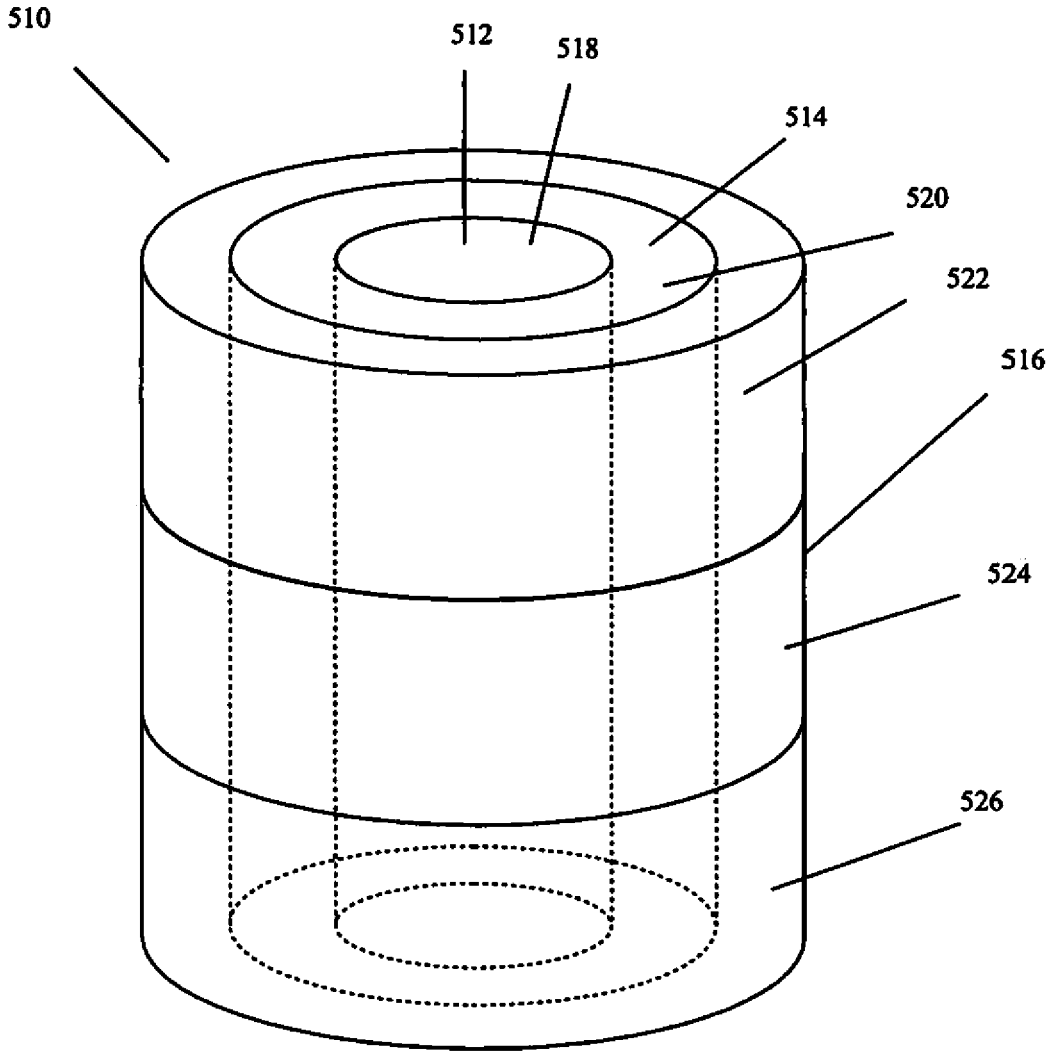
FIG. 10 is a schematic perspective view showing a plug according to a sixth embodiment of the present invention.

A sixth embodiment of the present invention is shown in FIG. 10. In this embodiment the plug 510 comprises three concentric layers of material 512, 514, 516. The inner layer 512 comprises a first propellant material 518, the second layer 514 comprises a second propellant material 520 and the third layer 516 comprises three rings of propellant material 522, 524, 526.

The use of different propellant materials creates different rates of deflagration as the plug 510 collapses. Each layer is separated by an isolating sheath (not shown) and has its own initiator (not shown). This arrangement allows each layer to be triggered without igniting an adjacent layer.

Figure 11:
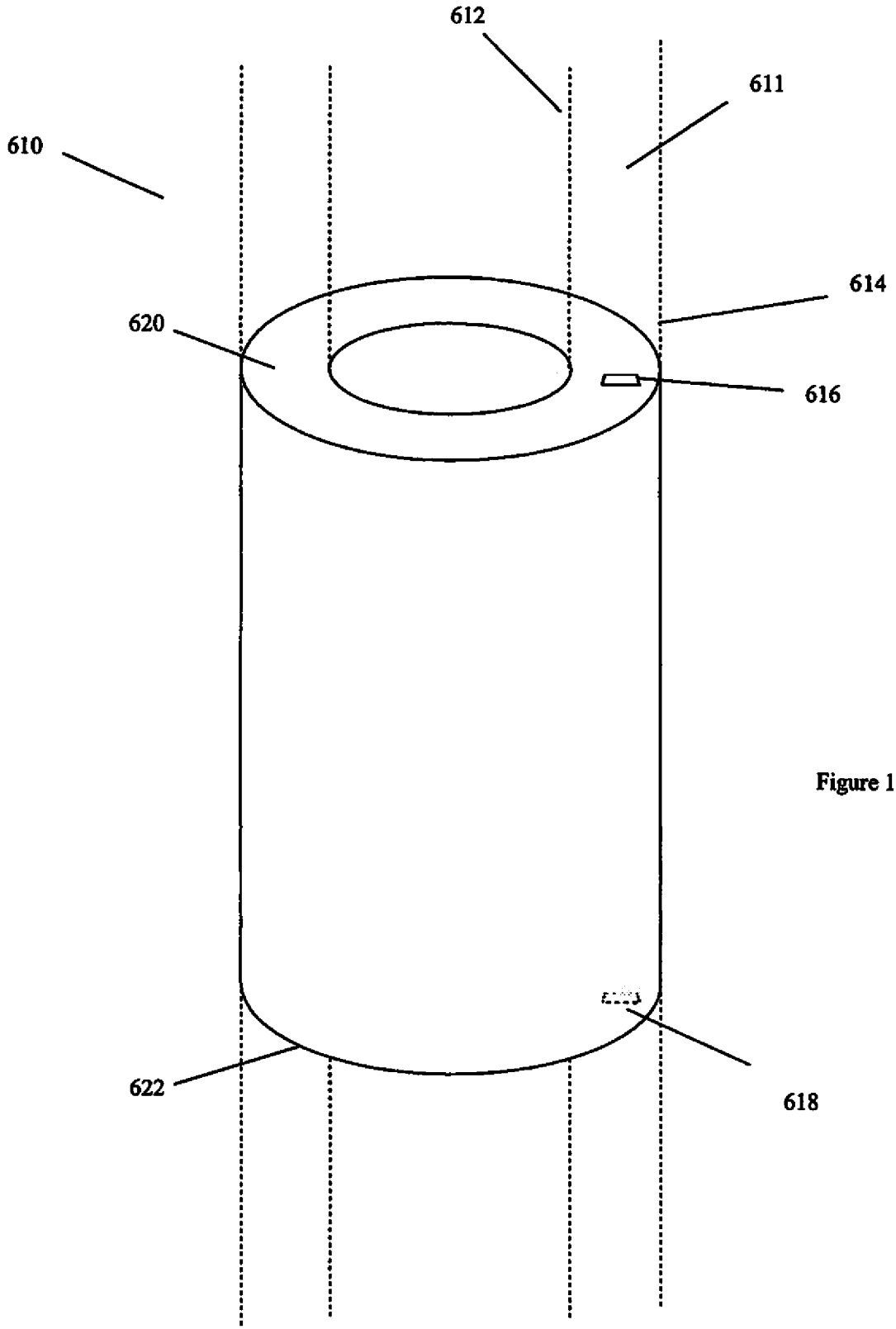
FIG. 11 is a schematic perspective view showing a plug according to a seventh embodiment of the present invention.

A seventh embodiment of the present invention is shown in FIG. 11. In this embodiment, a plug 610 is an annular plug fitted in an annulus 611 between a tube 612 and a casing 614 (shown in broken outline for context). The plug 610 further comprises a first transceiver sensor 616 and a second transceiver sensor 618, the first sensor 616 being located on an upper surface 620 of the plug 610 and the second sensor 618 being located on a lower surface 622 of the plug 610.

These sensors 616, 618 are in communication with surface and relay information relating to the pressure in the annulus 611 above and below the plug. This information may be used to decide when to collapse the plug 610, for example, when the pressure is equalised across the plug 610.

Figure 12:
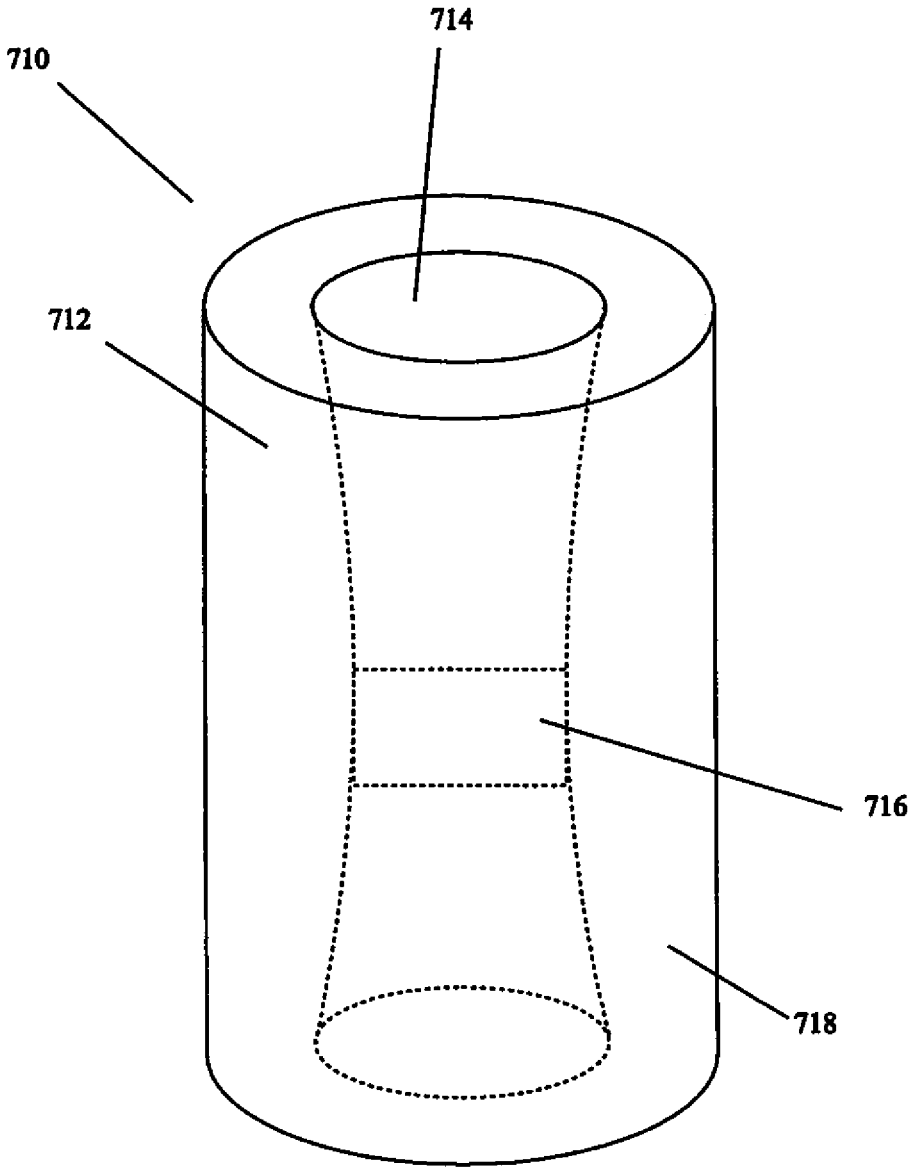
FIG. 12 is a schematic perspective view showing a plug according to a eighth embodiment of the present invention.

An eighth embodiment of the present invention is shown in FIG. 12. In this embodiment, a plug 710 has an outer annular block of propellant 712 with an internal block of propellant 714. The internal block of propellant tapers from both ends towards the middle of the plug 710. Located in the middle of the plug 710 is a flow turbine 716. The flow turbine 716 is embedded in the internal block of propellant 714. In use, the plug 710 would be set in a wellbore and at an appropriate moment, the internal block of propellant 714 would be initiated and would burn away leaving the flow turbine 716 in a conduit 718 through the outer annular block of propellant 712.

The flow turbine 716 would then be able to measure flow rates or generate an electric current from the flow through the plug conduit 718.

In alternative embodiments, the internal block of propellant could be burnt away leaving just the annular block of propellant 712, the annular block of propellant 712 then being used as a hanger or a tool support to suspend an object into the well below the annular block of propellant 712.

Figure 13:
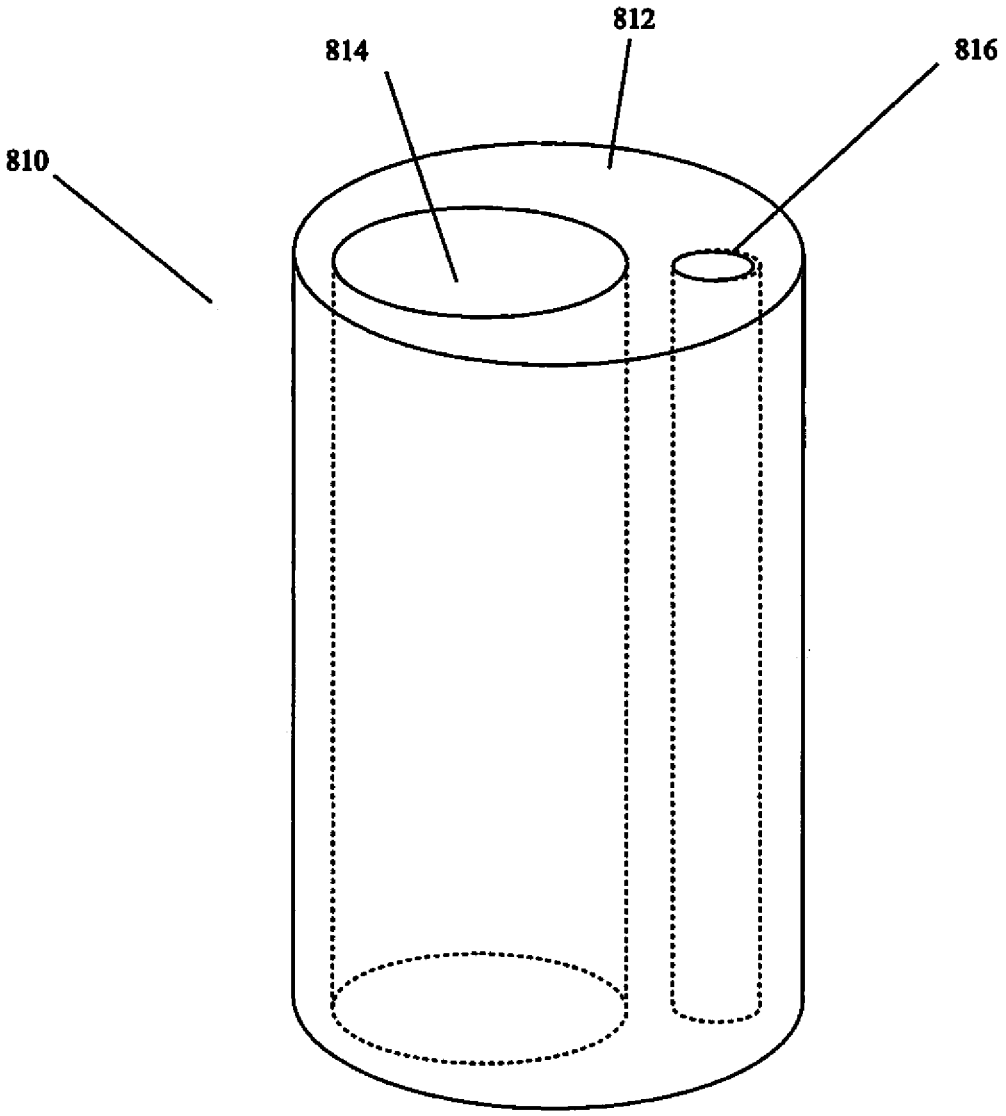
FIG. 13 is a schematic perspective view showing a plug according to a ninth embodiment of the present invention.

A ninth embodiment of the present invention is shown in FIG. 13. In this embodiment, a plug 810 is made of a propellant outer body 812, and two cylindrical inner bodies 814, 816 of propellant. The thinner body 816 is lined with a steel sheath (not shown) to isolate it from the propellant outer body 812.

In use when plugging a conduit, the thinner body 816 can be initiated and consumed to open up a flow path through the plug 810 to equalise pressure. This allows the rest of the plug 810 or just the larger inner body to 814 be initiated and consumed, thereby opening the conduit up again.

Various modifications and improvements may be made to the above-described embodiment without departing from the scope of the invention. For example, although propellant is shown in some of the embodiments, any suitable consumable may be used. A rubber or chemical composition that when exposed to wellbore fluid or a non-wellbore fluid is consumed and may be the consumable. A solid that dissolves in water is another example, another might a solid that melts when exposed to heat and another may be that it breaks up when exposed to pressure.

In other embodiments the plug may include chemical tracers to mark fluids flowing through the plug.

The invention claimed is:

1. An improved plug for sealing a tubular; the improved plug comprising: a plug body, the plug body comprising a propellant and at least one other material; and an initiator adapted to initiate the propellant upon a signal;

wherein upon initiation the propellant deflagrates causing only the propellant to at least partially disintegrate, disintegration of the propellant causing the plug body to at least partially collapse.

2. The plug of claim 1, wherein the plug body fully comprises the propellant.

3. The plug of claim 1, wherein the plug further comprises a housing, the housing adapted to receive the plug body.

4. The plug of claim 3, wherein the housing is adapted to engage, in use, a tubular wall.

5. The plug of claim 1, wherein the plug further comprises one or more sensors.

6. The plug of claim 5, wherein the plug further comprises a transmitter adapted to transmit information from location to the surface.

7. An improved plug for sealing a tubular; the improved plug comprising: a plug body, the plug body comprising a consumable and at least one other material; and an initiator adapted upon a signal to expose the consumable to a condition in which the consumable will be consumed causing only the consumable to disintegrate, disintegration of the consumable causing the plug body to at least partially collapse.

8. An improved tool for sealing a tubular; the improved tool comprising: a tool body, the tool body comprising a consumable and at least one other material; and an initiator adapted upon a signal to expose the consumable to a condition in which only the consumable will be consumed, causing the consumable to at least partially disintegrate, disintegration of the consumable causing the plug body to at least partially collapse.

9. An improved tool for use downhole; the improved tool comprising:

a tool body, the tool body comprising a propellant, and at least one other material; and an initiator adapted to initiate the propellant upon a signal;

wherein upon initiation the propellant deflagrates causing only the propellant to at least partially disintegrate disintegration of the propellant causing the tool body to at least partially collapse.

10. The tool of claim 9, wherein the tool further comprises one or more sensors.

11. The tool of claim 10, wherein the tool further comprises a transmitter, transmitter being adapted to transmit information from the sensors to a remote location such as surface.

* * * * *